United States Patent [19]

Kamiwano et al.

[11] Patent Number: 5,069,393

[45] Date of Patent: Dec. 3, 1991

[54] DISPERSING AND GRINDING APPARATUS

[75] Inventors: Mitsuo Kamiwano, Yokohama; Yoshitaka Inoue, Minato, both of Japan

[73] Assignee: Inoue Seisakusho (Mfg.) Co., Ltd., Japan

[21] Appl. No.: 622,426

[22] Filed: Dec. 5, 1990

[30] Foreign Application Priority Data

Dec. 5, 1989 [JP] Japan ..... 1-314418

[51] Int. Cl.[5] ..... B02C 17/16

[52] U.S. Cl. ..... 241/46.17; 241/172

[58] Field of Search ..... 241/172, 46.17, 261.1, 241/260, 46.15

[56] References Cited

U.S. PATENT DOCUMENTS

| | | | |
|---|---|---|---|
| 3,199,792 | 8/1965 | Norris, Jr. | 241/179 X |
| 3,806,050 | 4/1974 | Cumpston, Jr. | 241/260 |
| 3,993,254 | 11/1976 | Bicik et al. | 241/172 X |
| 4,042,183 | 8/1977 | Cumpston | 241/260 X |
| 4,684,072 | 8/1987 | Nelson et al. | 241/172 |
| 4,919,347 | 4/1990 | Klumaschka et al. | 241/172 X |
| 4,919,347 | 4/1990 | Kamiwano et al. | 241/63 |

*Primary Examiner*—Mark Rosenbaum

*Assistant Examiner*—Frances Chin

*Attorney, Agent, or Firm*—Bruce L. Adams; Van C. Wilks

[57] ABSTRACT

A dispersing and grinding apparatus comprises a vessel having an inlet for receiving a material to be processed and an outlet for discharging the processed material. A rotor is rotatably disposed within the vessel and positioned relative to the inner wall of the vessel to define therebetween a narrow, annular flow path for the passage therethrough of a mixture of the material and a grinding medium. The rotor has a plurality of axially extending grooves on the periphery thereof for guiding the mixture in the circumferential direction as the rotor rotates. The rotor is separated into a plurality of processing zones in the axial direction thereof, and the grooves in each processing zone are phase shifted in the circumferential direction with respect to the grooves in adjacent processing zones. When the mixture transfers from one processing zone to an adjacent processing zone, the velocity difference of the mixture is adjusted so that the mixture advances, as a whole, at approximately equal velocity through the narrow, annular flow path whereby the material is uniformly ground and dispersed.

17 Claims, 3 Drawing Sheets

DISPERSING AND GRINDING APPARATUS

BACKGROUND OF THE INVENTION (1) Field of the Invention

The present invention relates to a dispersing and grinding apparatus for finely grinding materials and dispersing them into liquid by means of a grinding medium such as balls, beads, etc.

(2) Background Information

It is supposed that a dispersing and grinding apparatus, which has a plurality of discs or agitating blades disposed within a vessel to disperse a material, applies centrifugal force to a mixture of a grinding medium and the material by rotation of the discs, circulates the grinding medium between the discs, during which the grinding medium captures the material, and disperses the material by shearing forces. However, the flow characteristic of such a mixture is not uniform throughout the vessel. For this reason, the flow of the grinding medium often causes a short pass or dead space, whereby it is difficult to obtain uniform shearing forces. Although it has been known to provide an inner cylinder within a vessel of a dispersing and grinding apparatus to apply motion to the grinding medium by rotation of the inner cylinder, such a technique does not always effect movement of the grinding medium at approximately equal velocity throughout the inner cylinder.

The present inventors have proposed a dispersing and grinding apparatus having a rotor disposed within a vessel and having a guiding means disposed on the periphery of the rotor for controlling the flow of the grinding medium. Such an apparatus is disclosed in U.S. Pat. No. 4,919,347. It has been confirmed that, according to the dispersing and grinding apparatus described in the aforesaid patent, a material-grinding medium mixture flows through a narrow, annular flow path between the rotor and the vessel by guiding means in the form of an array of forward guide surfaces and an array of rearward guide surfaces in a manner which approximates a plug flow, and flows around the periphery of the rotor without causing the formation of high velocity gradients. Since then, the present inventors have investigated various structures as the above-mentioned guiding means, and also studied a structure in which protrusions and grooves are disposed in the axial direction of the rotor in the shape of a toothed wheel. However, in such a structure, the mixture which enters the grooves of the rotor causes a velocity difference in the axial direction, and the mixture tends to advance straight toward the outlet from the inlet of the vessel so that sufficient dispersion effect sometimes cannot be obtained.

SUMMARY OF THE INVENTION

An object of the present invention is to provide a dispersing and grinding apparatus which enables an efficient dispersion treatment of a material-grinding medium mixture by applying uniform motion to the mixture.

Another object of the present invention is to provide a dispersing and grinding apparatus which enables sufficient grinding and dispersion of the material-grinding medium mixture, in the course of transfer of the mixture from the inlet to the outlet of the vessel, by applying motion to the mixture in the circumferential direction without causing a velocity difference in the axial direction.

According to the present invention, the foregoing objects as well as other objects of the present invention can be accomplished by a dispersing and grinding apparatus comprising a vessel having a rotor rotatably disposed within the vessel and positioned to define a narrow, annular flow path with the inner wall of the vessel, wherein the rotor is partitioned into a plurality of processing zones along the axial direction thereof. The processing zones are provided with grooves extending in the axial direction, and the processing zones are arranged with a phase difference between the grooves of adjacent processing zones.

Other objects and features of the present invention will be apparent to those skilled in the art upon a reading of the following description with reference to the accompanying drawings.

DESCRIPTION OF THE PREFERRED EMBODIMENTS

Figure 1:
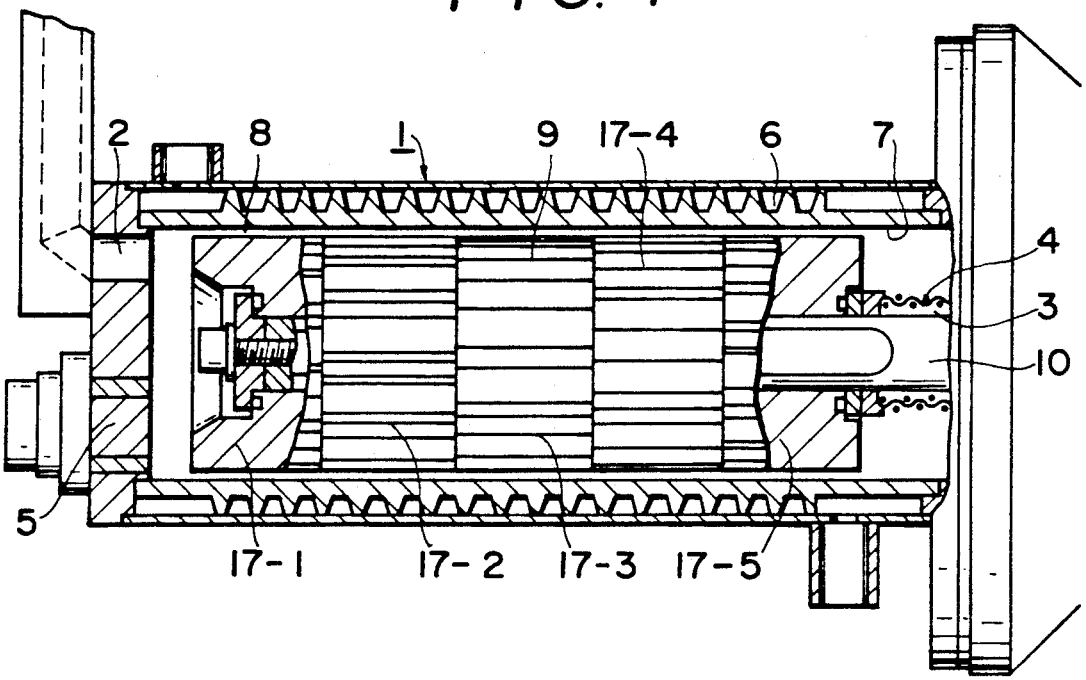
FIG. 1 is a cross-sectional side view of an embodiment of the dispersing and grinding apparatus of the present invention.

FIG. 1 shows a horizontal-type dispersing and grinding apparatus of the present invention. The present invention is also applicable to a vertical-type dispersing and grinding apparatus. A vessel 1 has an inlet 2 at one end for supplying a material by means of a supply pump (not shown) and an outlet 3 at the other end for discharging the ground, dispersed material. A grinding medium separating means 4, such as a screen, a gap-type separator, etc., is provided at the outlet 3 to prevent the grinding medium, such as glass beads, ceramic, alumina, zirconia, steel, etc., from flowing out of the vessel 1. The grinding medium can be drained out by opening a drain port 5. A heat-transfer jacket 6 is provided on the outer periphery of the vessel 1 to control the temperature in the vessel 1.

A rotor 9 is disposed within the vessel 1 to define a narrow, annular flow path 8, through which the material-grinding medium mixture circulates, between the rotor and an inner wall 7 of the vessel 1. The rotor 9 is connected to a rotary shaft which is rotationally driven by a suitable driving means not shown in the figure. In the embodiment shown in FIG. 1, the rotor 9 has a cylindrical shape, but, instead of the cylindrical shape, the rotor may have a polygonal column shape having a cross-section approximating a triangle, quadrilateral, etc. or may be in the form of a cylindroid. The rotor may also be constructed so that cooling water may be circulated in the rotor.

Figure 2:
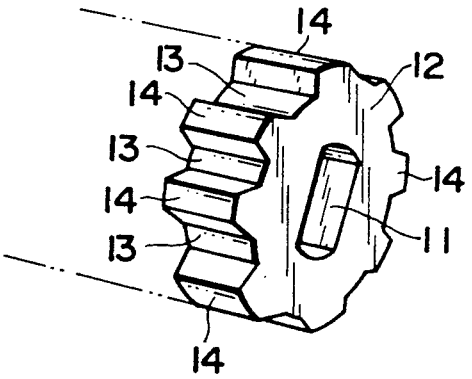
FIG. 2 is a perspective side view showing one of the rotor elements constituting the rotor of the present invention.

As shown in FIG. 2, the rotor 9 is constructed by preparing a plurality of rotor elements 12 each having a non-circular through-hole 11 configured to engage with a complementary-shaped portion of the rotary shaft 10, and inserting the rotary shaft 10 through the through-holes 11 of the rotor elements 12. The rotor may also be molded as a one-piece integral body.

Figure 3:
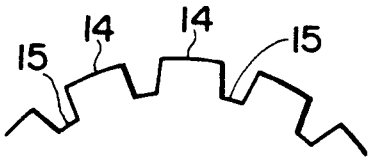
FIG. 3 is an explanatory front view of a part showing an embodiment of the rotor of the present invention.
Figure 4:
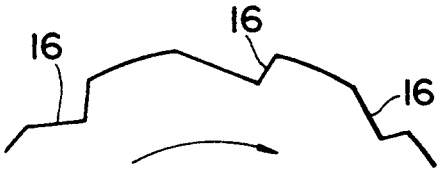
FIG. 4 is an explanatory front view of a part showing another embodiment of the rotor of the present invention.
Figure 5:
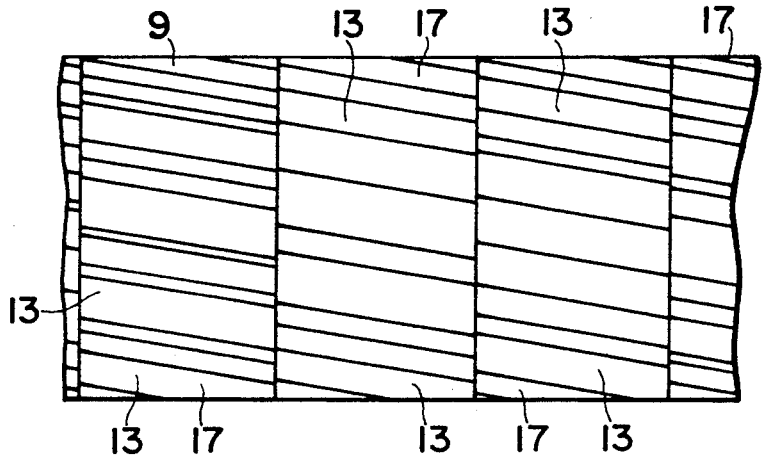
FIG. 5 is a side view of a part showing another embodiment of the rotor of the present invention.
Figure 6:
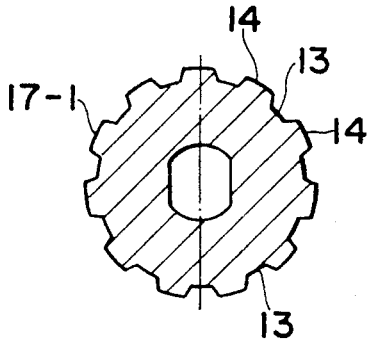
FIG. 6 is a sectional view of a first element of the rotor elements constituting the rotor of the present invention.
Figure 7:
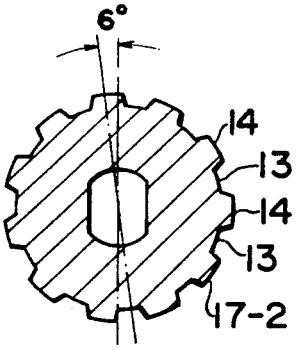
FIG. 7 is a sectional view of a second element of the rotor elements constituting the rotor of the present invention.
Figure 8:
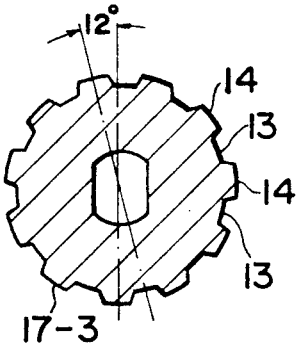
FIG. 8 is a sectional view of a third element of the rotor elements constituting the rotor of the present invention.
Figure 9:
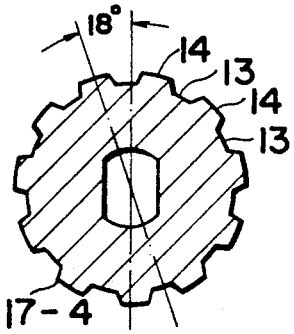
FIG. 9 is a sectional view of a fourth element of the rotor elements constituting the rotor of the present invention.
Figure 10:
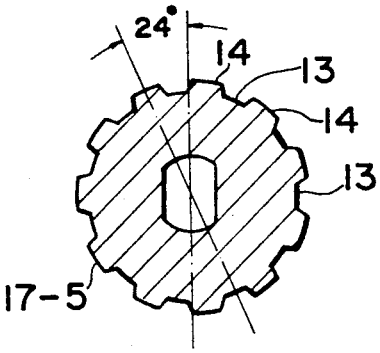
FIG. 10 is a sectional view of a fifth element of the rotor elements constituting the rotor of the present invention.

The annular flow path 8, which is formed in an appropriate radial width depending on the processing conditions and the size of the grinding medium, has a radial width greater than at least four pieces of the grinding medium in order not to interfere with the rotary motion of the rotor 9. On the outer peripheral surface of the rotor 9, a series of axial grooves 13 are formed, extending in the axial direction of the rotor, to positively guide the material-grinding medium mixture supplied into the annular flow path 8 in the circumferential direction. In the figure, each groove 13 is formed between two protrusions 14 and 14 in the form of a toothed-wheel shape, and thus the rotor 9 can be prepared like a gear on a spline shaft. The grooves have an involute configuration, but may be formed as quadrilateral-shaped grooves 15 as shown in FIG. 3. Alternatively, as shown in FIG. 4, the grooves may be formed as L-letter shaped grooves 16. The grooves may be formed in various other configurations as well. The grooves can be prepared by a casting method, such as the lost wax process or the like. In the case of the rotor element 12 shown in FIG. 2, the grooves 13 may be prepared by machining. The pitch of the grooves is approximately determined depending on the number of revolutions of the rotor and the properties of the material to be processed. The grooves are provided in parallel with respect to the axial direction, but may be provided with a slight obliquity relative to the axial direction like a helical gear, as shown in FIG. 5.

Figure 11:
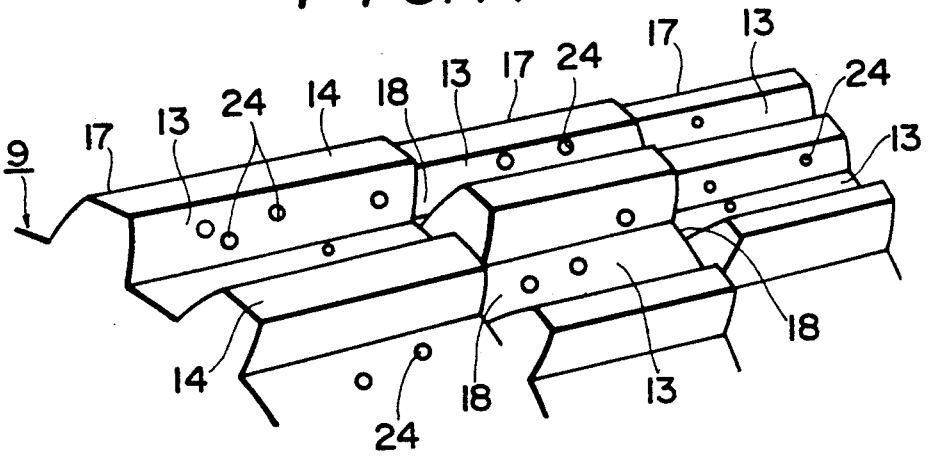
FIG. 11 is an enlarged perspective side view of a part of the rotor of the present invention.

The rotor 9 is partitioned into plurality of axially spaced processing zones 17,17, . . . in the axial direction of the rotor. The processing zones are arranged with a phase difference between the grooves of adjacent processing zones. For example, the rotor 9 shown in FIG. 1 is partitioned into five processing zones, 17-1, 17-2, 17-3, 17-4 and 17-5, by respective rotor elements such as, for example, the rotor elements 12 shown in FIG. 2. As shown in FIG. 6 to FIG. 10, the phases of the grooves of respective processing zones are each shifted by 6 degrees. As shown in FIG. 11, the aperture width of communicating sections 18 between the grooves of adjacent processing zones varies depending on the phase shift angle. The aperture width of respective communicating sections 18 preferably has a size through which at least on piece of grinding medium is permitted to pass while applying friction to the flow of the grinding medium. The phases of the grooves may occasionally be shifted in such a condition that the communicating section 18 does not exist. In the instance where the rotor 9 is comprised of the rotor elements 12 as shown in FIG. 2, since the pitch of the grooves 13 is constant, the rotor 9 can be prepared by providing rotor elements in which the position of the non-circular through-hole 11 and the position of the grooves 13 are shifted little-by-little in the circumferential direction, as shown, for example, in FIG. 5 to FIG. 10, and inserting the rotary shaft 10 through these rotor elements.

Figure 12:
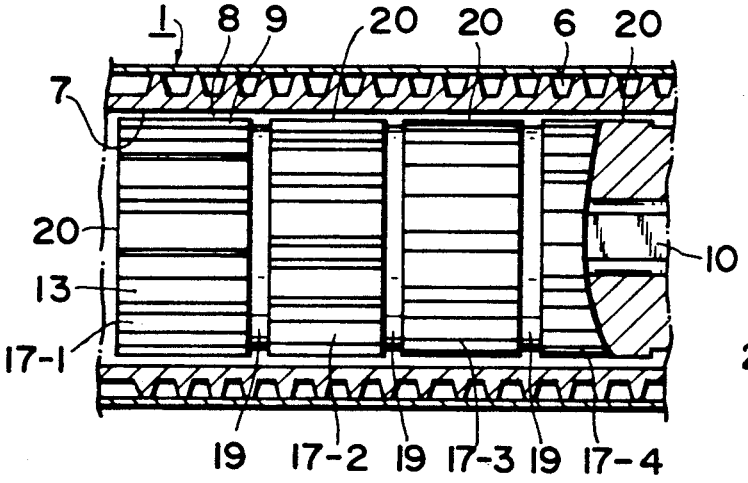
FIG. 12 is a cross-sectional side showing another embodiment of the dispersing and grinding apparatus of the present invention.

In FIG. 12, another embodiment of the rotor of the present invention is shown. In this figure, the construction of the rotor 9 rotatably disposed within a vessel 1 defining an annular flow path 8, grooves 13 provided on the rotor 9 in the axial direction, and the processing zones 17-1, 17-2, 17-3, 17-4 are the same as those of the embodiment shown in FIG. 1. Thus, the same portions are indicated with the same numerals.

Figure 13:
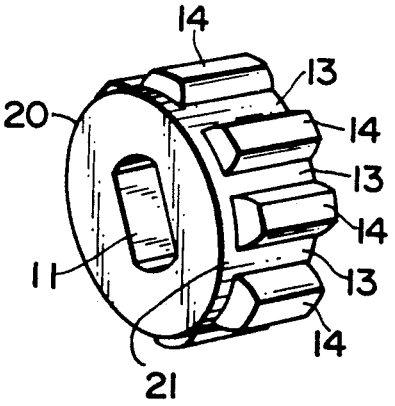
FIG. 13 is a perspective side view showing a rotor element constituting the rotor of the present invention shown in FIG. 2.

The FIG. 12 embodiment is different from the FIG. 1 embodiment in that annular grooves 19 extending in the circumferential direction of the rotor 9 are formed between respective processing zones. The annular grooves 19 are, as shown in FIG. 13, formed by rotor elements 20 each having grooves 13 and protrusions 14,14 extending in the axial direction, a non-circular through-hole 11, and a cylindrical-shaped section 21 on the side portion of the rotor element 20, and by inserting the rotary shaft 10 through the through-holes 11 of the rotor elements 20 to connect the rotor elements 20 in side-by-side relationship such that the cylindrical sections 21 define the annular grooves 19. When the rotor 9 is molded as a one-piece integral body, the annular grooves 19 may be formed by machining the rotor in the circumferential direction to form the annular grooves.

By forming the grooves 19 in the circumferential direction between respective processing zones 17, the material-grinding medium mixture flows from an upstream processing zone into an annular groove 19, and circulates in the circumferential direction in the groove 19 before advancing to the next downstream processing zone. In this manner, the velocity difference of the mixture can be corrected.

Alternatively, the annular grooves and processing zones may, as mentioned above, be formed on the inner wall 7 of the vessel 1.

Figure 14:
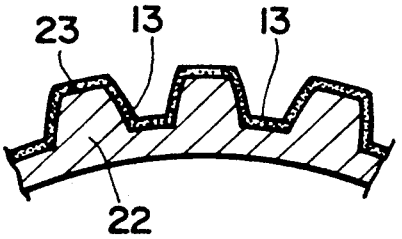
FIG. 14 is an enlarged sectional view of a part of the rotor of the present invention.

The surface of the rotor 9 and the inner wall 7 of the vessel 1 are preferably composed of anti-corrosion material. As suitable anti-corrosion materials, ultra rigid materials such as ceramic, tungsten carbide, etc. are commercially available. These ultra rigid materials may be used for the formation of the whole body, or may be used for the formation of only the surface layer portion which is to be coated. As shown in FIG. 14, these ultra rigid materials may also be flame-sprayed by deflagration type (explosion type) flame-spraying on a substrate 22 to form a protection layer 23 containing the anti-corrosion material.

In operation, a material to be processed is charged into the vessel 1 through the inlet 2 under a suitable charging pressure by a supply pump (not shown), and the material is mixed with numerous grinding mediums 24 contained in the vessel and supplied to the annular flow path 8. The mixture is then circulated around the rotor 9 by rotation of the rotor and is further guided in the circumferential direction by the grooves 13 formed on the outer peripheral surface of the rotor. The mixture flows axially through the vessel 1 like a plug flow. In this instance, even if a velocity difference occurs in the axial direction, the grooves 13 of the respective processing zones 17 are arranged with a phase difference therebetween to effectively inhibit high velocity flow as the mixture transfers from one processing zone to another processing zone. Accordingly, the mixture transfers from one processing zone to another at approximately equal velocity as a whole. The mixture flows out from the annular flow path and discharges from the vessel 1 through the outlet 3. During its flow through the vessel 1, the material is applied with sufficient shearing force by the grinding medium and is thus finely ground.

In accordance with the invention, the material charged in the vessel flows without creation of a large velocity difference in the axial direction during passage of the material through the annular flow path, and the flow thereby approximates a plug flow. Therefore, the material receives uniform shearing forces during operation of the apparatus and is uniformly dispersed thereby attaining sharp particle size distribution an improved dispersion efficiency.

We claim:

1. A dispersing and grinding apparatus comprising: a vessel for receiving a grinding medium and a material to be processed, the vessel having an inlet for admitting the material into the vessel and an outlet for discharging processed material from the vessel; and a rotor rotatably disposed within the vessel and positioned relative to an inner wall of the vessel to define therebetween a narrow, annular flow path communicating with the inlet and outlet for the passage therethrough of a mixture of the material and the grinding medium; and wherein one of the rotor and the vessel inner wall has a plurality of axially extending processing zones, each processing zone having a plurality of circumferentially spaced-apart and axially extending protrusions separated by axially extending grooves, and the grooves in each processing zone being phase shifted in the circumferential direction with respect to the grooves in adjacent processing zones.

2. A dispersing and grinding apparatus according to claim 1; wherein the grooves extend obliquely relative to the axial direction of the rotor.

3. A dispersing and grinding apparatus according to claim 1; including means defining an annular groove between each two adjacent processing zones.

4. A dispersing and grinding apparatus according to claim 1; wherein the axially extending grooves in each two adjacent processing zones are phase shifted relative to each another such that the grooves in one processing zone communicate with the grooves in the other processing zone through respective apertures, the apertures having a size large enough to permit the passage therethrough of at least one piece of grinding medium.

5. A dispersing and grinding apparatus according to claim 4; wherein the apertures have a tapered shape, the smallest dimension of the tapered shape being slightly larger in size than that of the largest piece of grinding medium.

6. A dispersing and grinding apparatus according to claim 1; wherein the processing zones are provided on the rotor.

7. A dispersing and grinding apparatus according to claim 6; wherein the grooves extend obliquely relative to the axial direction of the rotor.

8. A dispersing and grinding apparatus according to claim 6; including means defining an annular groove between each two adjacent processing zones.

9. A dispersing and grinding apparatus according to claim 6; wherein the axially extending grooves in each two adjacent processing zones are phase shifted relative to each another such that the grooves in one processing zone communicate with the grooves in the other processing zone through respective apertures, the apertures having a size large enough to permit the passage therethrough of at least one piece of grinding medium.

10. A dispersing and grinding apparatus according to claim 9; wherein the apertures have a tapered shape, the smallest dimension of the tapered shape being slightly larger in size than that of the largest piece of grinding medium.

11. A dispersing and grinding apparatus according to claim 6; wherein the rotor comprises a plurality of rotor elements connected together to rotate as a unit, each rotor element corresponding to one processing zone, and each rotor element having circumferentially spaced-apart and axially extending grooves on the peripheral surface thereof.

12. A dispersing and grinding apparatus according to claim 11; wherein the rotor has annular grooves therearound between each two adjacent processing zones.

13. A dispersing and grinding apparatus according to claim 12; wherein the rotor elements have a cylindrical section at one side portion thereof which is free of axially extending grooves, the cylindrical sections of the rotor elements defining the annular grooves.

14. A dispersing and grinding apparatus according to claim 11; wherein the rotor elements are comprised of anti-corrosion material.

15. A dispersing and grinding apparatus according to claim 11; wherein the rotor elements have a protective layer comprised of anti-corrosion material.

16. A dispersing and grinding apparatus according to claim 6; wherein the rotor is comprised of anti-corrosion material.

17. A dispersing and grinding apparatus according to claim 6; wherein the rotor has a protective layer comprised of anti-corrosion material.

* * * * *